United States Patent [19]

Burnecke et al.

[11] Patent Number: 4,477,959

[45] Date of Patent: Oct. 23, 1984

[54] METHOD AND DEVICES FOR CONSTRUCTING A SHACKLED CONVEYOR BELT FROM HELICAL ELEMENTS

[75] Inventors: Manfred Burnecke, Wettringen, Fed. Rep. of Germany; Swen Nyman, Tyringe, Sweden

[73] Assignee: Jürgens Maschinenbau GmbH & Co. KG., Emsdetten, Fed. Rep. of Germany

[21] Appl. No.: 444,505

[22] PCT Filed: Mar. 3, 1982

[86] PCT No.: PCT/EP82/00042

§ 371 Date: Nov. 8, 1982

§ 102(e) Date: Nov. 8, 1982

[87] PCT Pub. No.: WO82/03097

PCT Pub. Date: Sep. 16, 1982

[30] Foreign Application Priority Data

Jun. 3, 1981 [DE] Fed. Rep. of Germany ..... 3108522

[51] Int. Cl.[3] ..... B23P 19/04; B23P 11/02; B23P 19/02; B23P 21/00

[52] U.S. Cl. ..... 29/433; 29/235; 29/241; 29/450; 29/789; 140/3 R; 140/92.5; 245/6

[58] Field of Search ..... 29/433, 410, 450, 235, 29/241, 789; 140/3 R, 3 CA, 22, 92.5; 245/6, 5

[56] References Cited

U.S. PATENT DOCUMENTS

| | | | |
|---|---|---|---|
| 50,420 | 10/1865 | Kellogg | 245/6 UX |
| 145,907 | 12/1873 | Schpakowsky | 245/6 |
| 581,457 | 4/1897 | Deutsch | 245/6 UX |
| 2,183,169 | 12/1939 | Prentice | 29/410 |
| 2,550,898 | 5/1951 | Youngblood et al. | 29/241 |
| 2,740,615 | 4/1956 | Scholl | 245/6 X |
| 3,263,799 | 8/1966 | Bascom et al. | 245/6 X |
| 3,513,532 | 5/1970 | Lambert | 29/241 X |
| 3,731,365 | 5/1973 | Fryatt | 29/241 |
| 4,187,791 | 2/1980 | Moertel | 29/410 X |

FOREIGN PATENT DOCUMENTS

| | | | |
|---|---|---|---|
| 546320 | 11/1922 | France | 245/6 |

*Primary Examiner*—Charlie T. Moon
*Attorney, Agent, or Firm*—Michael J. Striker

[57] ABSTRACT

A method and apparatus for assembling a shackled conveyor belt from prepared helical elements having alternately a left handed thread and a right handed thread in a movable helical element connector which feeds individual helical elements towards the end helical element of the assembled portion of the conveyor by means of a feeding air flow.

Two each individual helical elements during the feeding movement are pushed towards each other in their longitudinal direction at an angle by means of the feeding air flow, then the two helical elements are parallelly deflected in the area of their joining with alternating interlacing of their spires. The front end in the feeding direction of the joined pair of helical elements is engaged by means of a feeding air flow at an acute angle to the associated end section of the end positioned helical element of the assembled portion of the shackle conveyor belt. The spires of one of the two helical elements of the pair of helical elements are pushed progressively from its end over the width of the shackled conveyor belt between the opposing spires of the end positioned helical element of the assembled portion of the shackled conveyor belt, and one connecting wire is inserted into each of two channels formed, on the one hand, by the helical elements of the pair of helical elements, and on the other hand, by one of the same and the end positioned helical element of the assembled portion of the shackled conveyor belt.

23 Claims, 6 Drawing Figures

METHOD AND DEVICES FOR CONSTRUCTING A SHACKLED CONVEYOR BELT FROM HELICAL ELEMENTS

BACKGROUND OF THE INVENTION

The invention relates to a method and a device for constructing a shackled conveyor belt from premade helical elements alternately with a left handed thread and a right handed thread, wherein the spires of adjacent helical elements are alternately pushed into each other and a connecting wire is fed through the channel formed by the interlaced spires of adjacent helical elements.

Heretofore, the pushing of the helical elements into each other was performed by hand, wherein only the introducing of the connecting wires was performed by means of a mechanical device of the type described in DE-AS No. 30 01 472. The shackled conveyor belts made in this manner usually consist of helical elements with an oval cross section made of plastic monofilament which are connected with each other by plastic connecting wires and are used, for example, as paper machine screens, conveyor belts, etc., wherein their light weight, the good stability and the manufacturability of large belt widths are advantageous.

In the DE-AS No. 30 17 378 which is not a prior publication, there is further described a method of the aforementioned type and a corresponding device, wherein always three or more helical elements are drawn through a wedge-shaped closing slot and are thereby pushed into each other. However, this mode of operation is disadvantageous in that the tension forces serving for the movement of the helical elements result in defective joints, due to the unavoidable minor differences occuring in the closing slot, whereby a plurality of spires of a helical element are pushed immediately adjacent between two spread apart spires of an adjacent helical element. In addition, when using three or a plurality of helical elements, the intermediate ones cannot be accurately fed, so that the connecting wires cannot be properly introduced.

SUMMARY OF THE INVENTION

It is an object of the invention to provide a method and a device for manufacturing a shackled conveyor belt of the aforementioned type which permit a mechanical manufacturing of such shackled conveyor belts with simple means, rapidly and substantially free from connecting defects.

For solving this object, the method of the aforementioned type is characterized in accordance with the invention by the features of the claim 6.

Therein, the helical elements are neither assiduously joined by hand, nor pulled through a closing slot, but each two helical elements are pushed toward each other in an angled position by means of an air flow and thereafter are parallely deflected by spreading apart and alternately pushing into each other of the individually facing helical spires, whereby the obtained pair of helical elements is adjoined with one of its two helical elements which are not yet connected by a connecting wire at an acute angle to the end portion of the shackled conveyor belt and is progressively pushed into it. Since neither the individual helical elements, nor the pair of helical elements are moved by a tension force, the individual spires of the helical elements are in tight abutment with each other until the spreading apart deflection, so that during the intermeshing of their spires practically no connection errors occur. Since the two helical elements of the pair of helical elements are pushed forward by an air flow without excerting any tension forces to widen the spire distance and thus the spreading of the spires to be connected of the end positioned helical element of the shackle belt conveyor and the helical element to be inserted therein completely correspond to each other, there are no resulting connection errors during the insertion of the pair of helical elements. Since the helical elements while moving through the curvature for parallel deflection are spread apart on one side only in the area where the spires are pushed into each other and due to their movement by an air flow the stretching and deformations under the influence of tension forces are prevented, generally a quick, substantially interference free operation and defect free shackled conveyor belt is obtained.

Furthermore, the subject matter of the invention also comprises a device for constructing a shackled conveyor belt from premade helical elements alternately with a left handed thread and right handed thread with a helical element connector displaceable over the width of the shackled conveyor belt and having a constricted feeding channel for helical elements fed therethrough with their spires pushed into each other, as well as devices for introducing connecting wires into the channels formed by the intermeshing spires of the helical elements.

In this device one helical element with a right handed thread and one helical element with a left handed thread are pushed forward from corresponding supply containers or supply rolls by means of corresponding feeding air flows through feeding channels with a corresponding cross section into the joining zone and are pushed into each other with spreading of their opposed spires between the deflecting faces disposed therein and cooperating with the sides of the helical elements facing away from each other and the obtained pair of helical elements is then adjoined by the feeding air stream through a guide channel at an acute angle to the associated segment of the end positioned helical element of the shackled conveyor belt and is progressively compressed with one of its helical elements into the end positioned helical element of the shackled conveyor belt during the displacement of the helical element connector in a direction opposite to the feeding movement of the pair of helical elements in the guide channel. Simultaneously with this pushing operation or thereafter two connecting wires are inserted through the two channels formed by the interlaced spires of, on the one hand, the two helical elements, and, on the other hand, of one of them and the end positioned helical element of the shackled conveyor belt. When the helical element connector has reached the end of the shackled conveyor belt during the insertion of the pair of helical elements, the newly inserted pair of helical elements is cut off there, the shackled conveyor belt is displaced relative to the helical element connector by one width of a helical element and then the helical element connector is moved back over the width of the shackled conveyor belt to its initial operating position at the other end thereof, whereupon the next pair of helical elements can be inserted.

In the following, preferred embodiments of the device will be further explained in conjunction with the enclosed drawings.

DETAILED DESCRIPTION OF THE PREFERRED EMBODIMENTS

Figure 1:
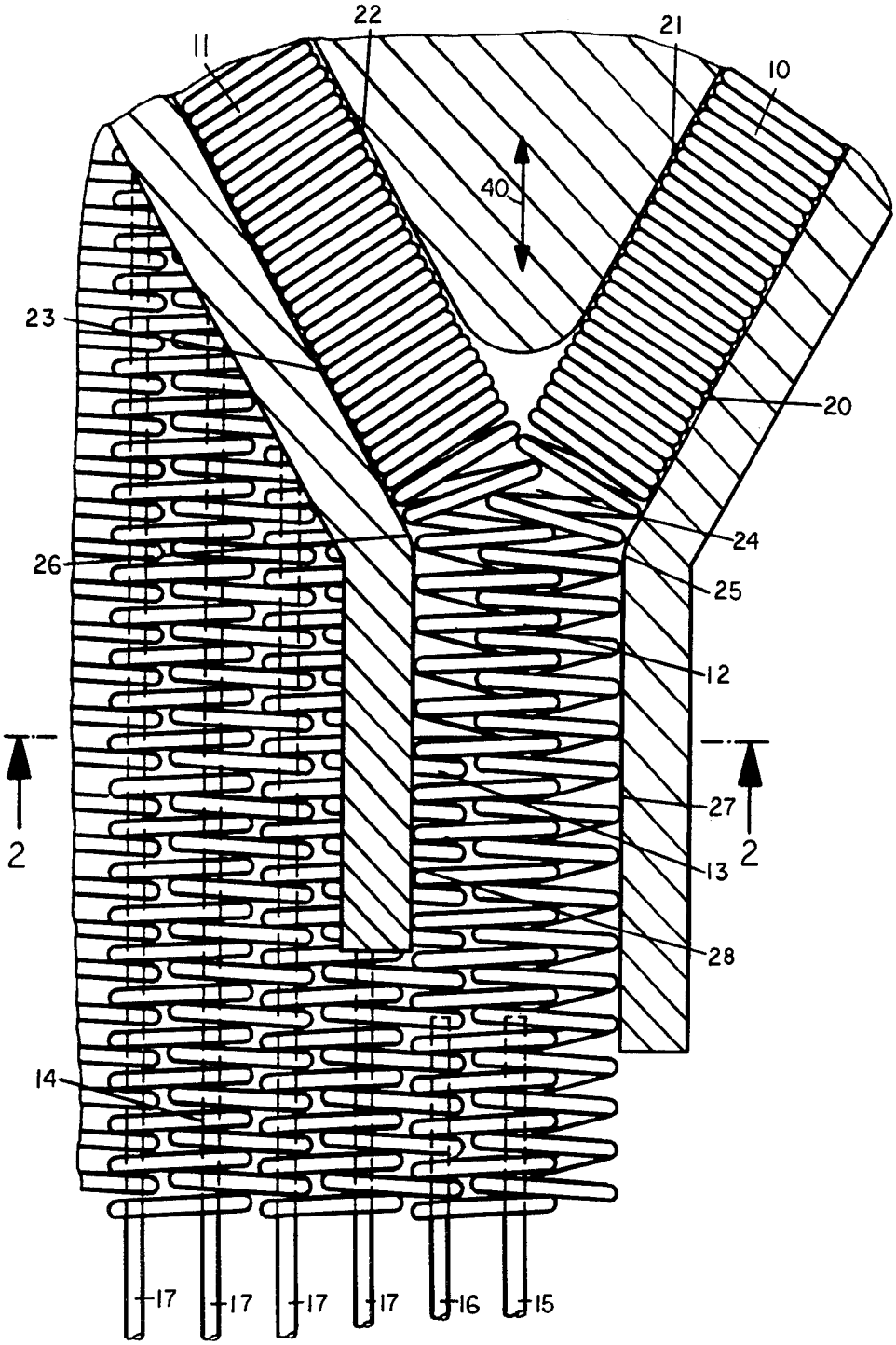
FIG. 1 is a partially sectional, schematic plan view of a helical connector.
Figure 2:
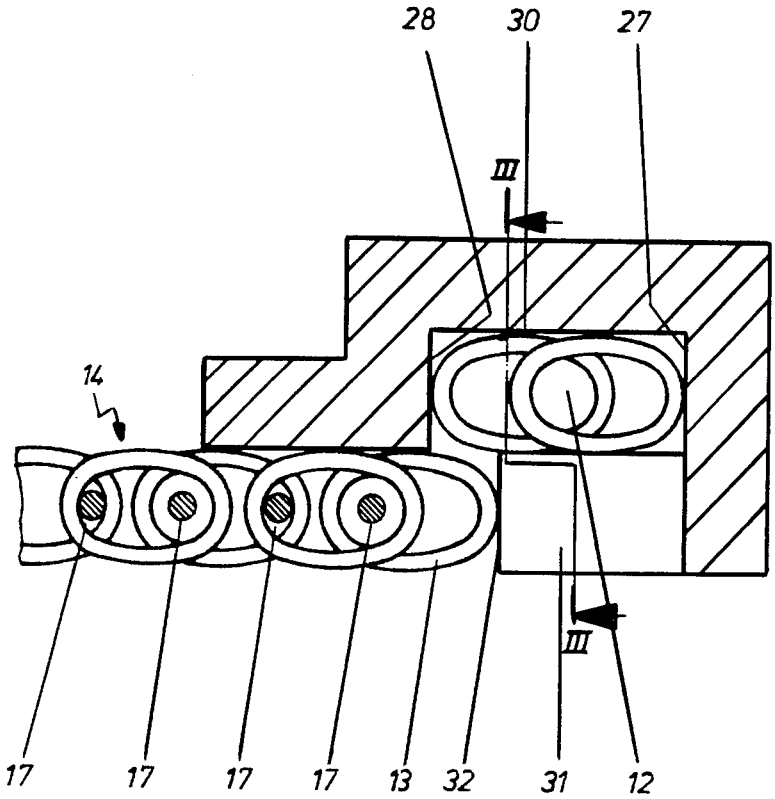
FIG. 2 is a schematic cross section along line II—II of FIG. 1.
Figure 3:
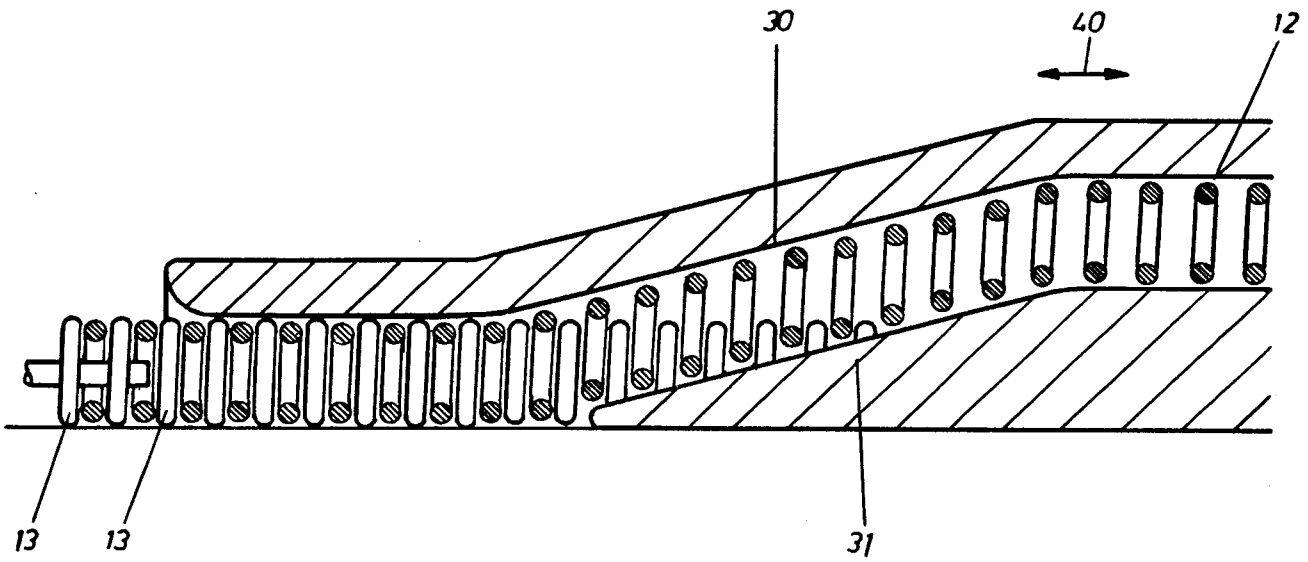
FIG. 3 is a schematic longitudinal section along the line III—III of FIG. 2.

In the device schematically illustrated in FIGS. 1 to 3, two individual helical elements of plastic monofilament having an oval spire cross section as shown in FIG. 2, are each fed towards each other in their longitudinal direction at a predetermined angle by means of air feeding flows through an associated feed channel with closed walls 20 and 21 or 22 and 23, as well as closed bottom and ceiling walls. The cross sectional dimensions of the feed channels are adjusted to the helical elements 10 and 11, so that they substantially cannot twist therein due to their oval or ellipse like spire cross section. The helical elements 10 and 11 meet in a joining zone 24 wherein they are deflected in such a manner by curved deflection faces 25, 26 cooperating with their sides turned away from each other into a guide channel of larger width, which channel extends at a blunt angle to the feed channels, so that the opposing spires of elements 10 and 11 spread out during deflection to alternatingly interlace. The pair of helical elements 12 formed thereby are pushed by the feeding air flow through the guide channel limited by side walls 27 and 28, a ceiling wall 30 and a bottom wall 31, the channel width being smaller than the double width of the helical elements 10 and 11, so that the opposing spires of the helical elements remain interlaced.

For connecting the pair of helical elements 12 with a previously formed shackled conveyor belt 14 consisting of a plurality of helical elements interlaced with their opposing spires, and connecting wires 17 of plastic monofilament introduced into the channels formed by the interlaced spires of adjacent helical elements, the pair of helical elements 12 pushed forward in the guide channel are engaged from above through the inclined cover wall 30 and bottom wall 31 in the discharge segment at an acute angle with one of its helical elements 11 on the opposing spires of the end positioned helical element 13 of the shackled conveyor belt 14 disposed on a support face and are inserted into the helical element during the displacements of the connectors containing the guide channel opposite to the feeding direction of the pair of helical elements 12 along the end positioned helical element 13 with alternating interlacing of the opposing spires of helical elements 11 and 13. Since, the spires of the helical elements 11 and 13 to be interlaced are equally spread apart by the previously made connection with the other helical element 10 of the pair of elements 12 or the adjacent helical element of the shackled conveyor belt 14, respectively, smooth, defect-free alternating interlacing is obtained despite the feeding of the pair of helical elements 12 by the air flow. In order to maintain the helical elements 11 and 13 aligned with respect to each other during the insertion, the helical element connector which contains the feeding channel with a guide wall 32 which cooperates in the operating position with the end positioned helical element 13 of the shackled conveyor belt 14 and supportingly slides along the still non-connected part of the end positioned helical element 13 of the shackled conveyor belt 14. In the bottom wall 31 of the discharge segment of the feeding channel, there is provided an opening 33 exposing the bottom side of the spires of the one helical element 11 of the pair of helical elements 12 to be inserted into the end positioned helical element 13 of the shackled conveyor belt 14, said opening being limited on the one side by guide wall 32 and on the other side by the side wall 28, adjacent to which a guide face 34 is provided abutting in the operating position against the upper side of the end segment of the shackled conveyor belt 14.

The bottom wall 31 of the guide channel is somewhat shorter relative to the cover wall 30, so that the cover wall 30 which extends down to the height of the guide face 34 assures a complete pushing of the spires of the helical element 11 of the pair of helical elements 12 into the opposing spires of the end positioned helical element 13 of the shackled conveyor belt 14.

Already while the described helical element connector is displaced rearwardly relative to the feeding direction of the pair of helical segments 12 in the feeding channel two connecting wires 15 and 16 can be introduced, corresponding to the progress of the insertion process, into the two channels 12*a* or 13*a* which are formed by the interlaced spires of the two helical elements 10 and 11 of the pair of helical elements 12, on the one hand, and of one of these and the end positioned helical element 13 of the shackled conveyor, on the other hand, by means of feeding devices, not shown. Although it is naturally possible to perform this operation step after the insertion of the pair of helical elements 12 over the total width of the shackled conveyor belt 14, it is advantageous for accelerating the manufacturing process and for facilitating the introduction process to introduce the connection wires 15 and 16 into channels 12*a* and 13*a* already during the insertion of the pair of helical elements 12, corresponding to the progress of connection, since the interlacing spires forming the channels are held in good alignment in close proximity behind the area of the complete interlacing of the helical elements 11 and 13 which facilitates the introduction of the connecting wires 15 and 16. Thereby, these connecting wires may be advantageously provided with bevelled cutting faces at their front ends.

When a pair of helical elements 12 is completely inserted in the end positioned helical element 13 of shackled conveyor belt 14, the pair of helical elements 12 is cut off at the edge of the shackled conveyor belt 14, the shackled conveyor belt 14 is displaced relative to the helical element connector by the width of one helical element 10, and the helical element connector is moved in the opposite direction of the direction of movement when insertion is effected to the opposite end of the now end positioned helical element of shackled conveyor belt 14 for inserting the next pair of helical elements 12.

Figure 4:
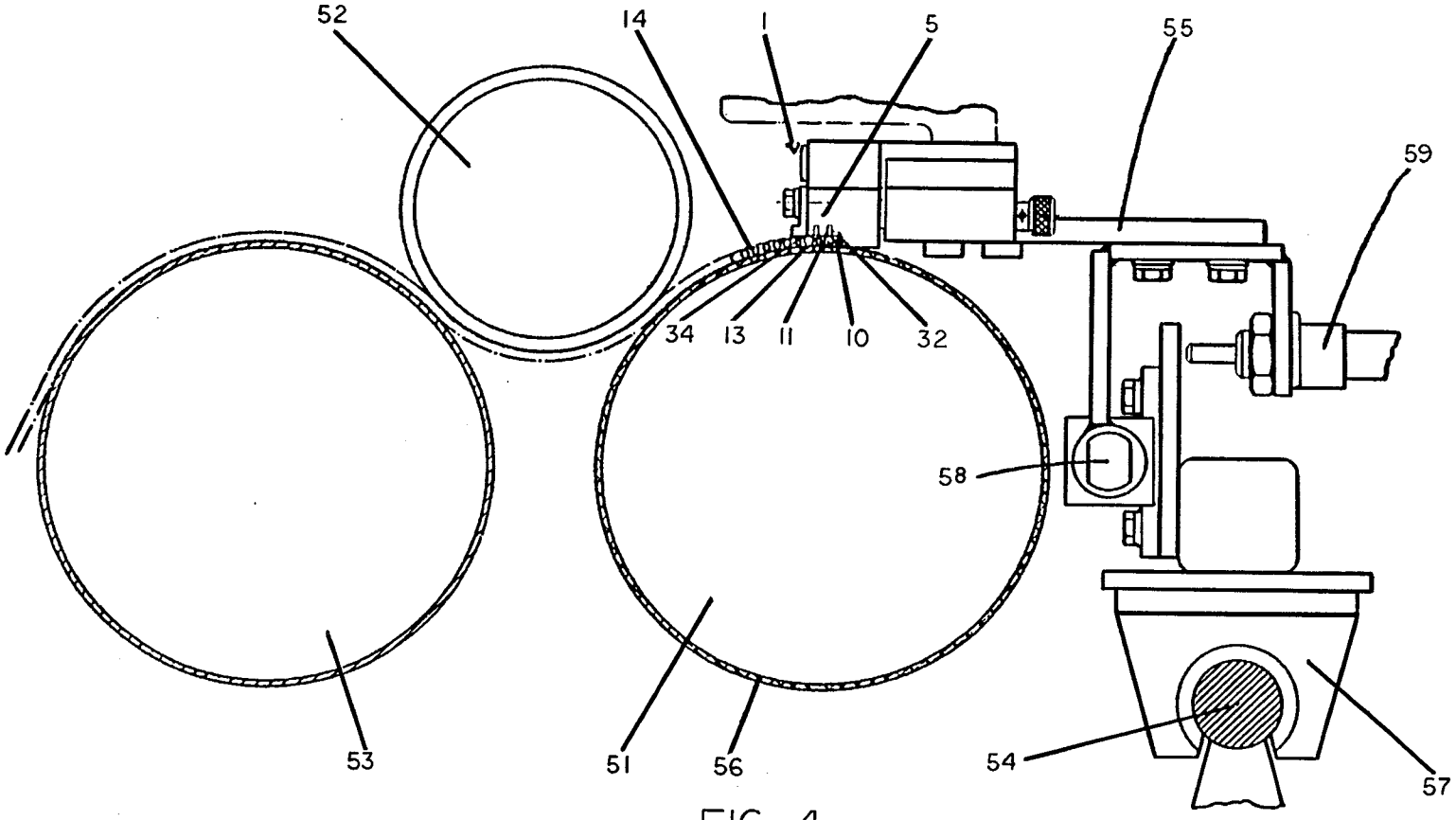
FIG. 4 is a partial view of a preferred embodiment of the device seen in the direction of the helical axes.
Figure 5:
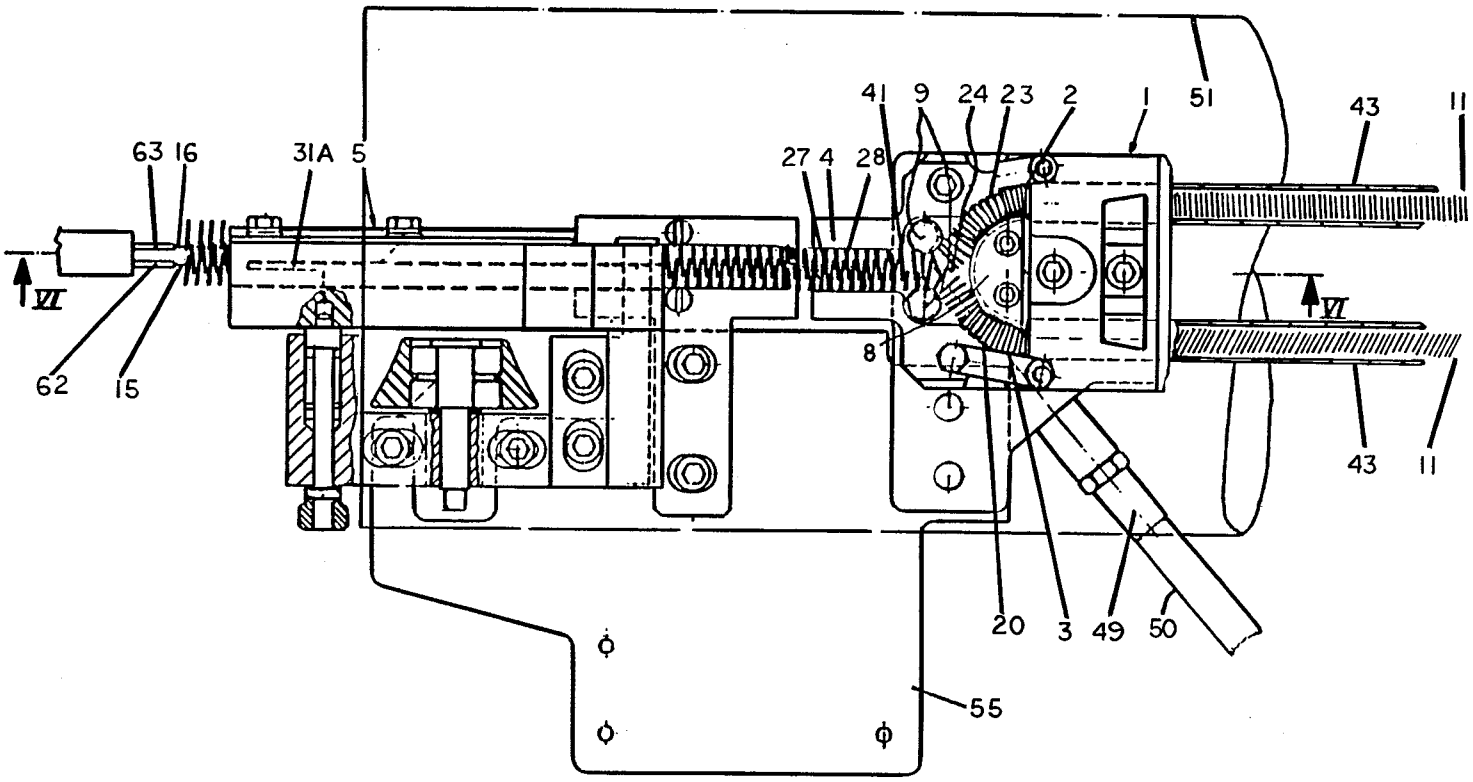
FIG. 5 is a partially broken off plan view of the helical element connector of the device in accordance with FIG. 4.
Figure 6:
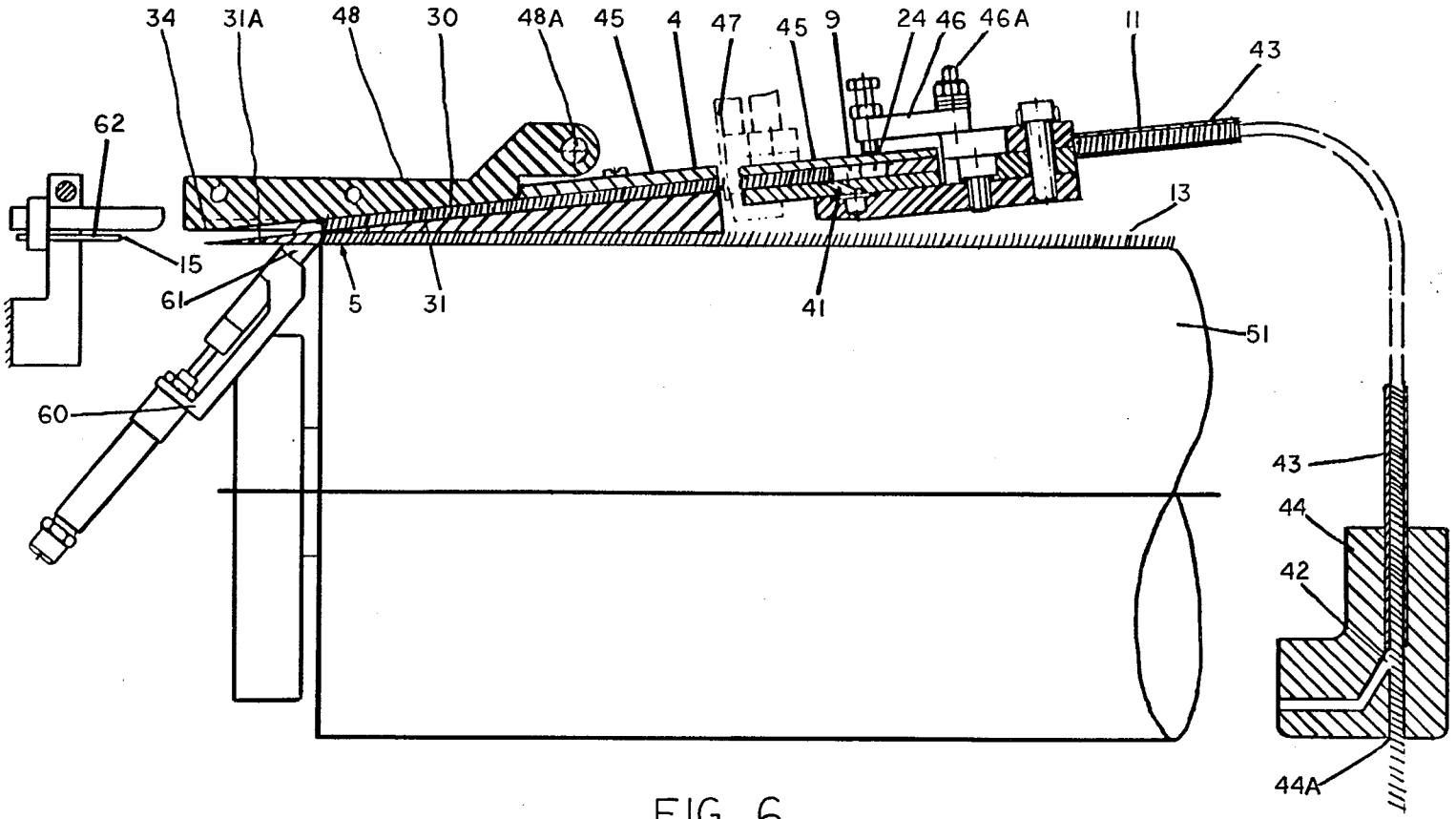
FIG. 6 is a longitudinal section through the helical element connector in accordance with FIG. 5, along line VI—VI.

The device illustrated in FIGS. 4 to 6 is provided with a guide roller 51 for the shackled conveyor belt 14 mounted in a schematically illustrated support frame 54. The guide roller 51 is provided with a friction cover 56 which makes a displacement of the shackled conveyor belt 14 in the circumferential direction more difficult. The shackled conveyor belt 14 is withdrawn from the guide roller 51 by a take-up roller 53, wherein the shackled conveyor belt 14 is held pressed against the friction cover 56 of the guide roller 51 and the circumferential face of the take-up roller 53, respectively, by means of a weighting or tension roller 52 optionally segmented in its axial direction and resting on the upper side of the shackled conveyor belt.

On the support frame 54 there is guided a slide 57 for reciprocating movement parallel to and along the total length of the rotary axis of guide roller 51. A helical element connector 1 of the type illustrated especially in FIGS. 5 and 6, is mounted on the slide 57 by means of a support plate 55. This helical element connector[1] is provided with feed channels 2 and 3 which are each connected by means of a flexible hose-like feed pipe 43 with a helical element supply container, not shown, which is moveable together with the helical element connector 1 over the width of the guide roller 51. The feed channels 2 and 3 adapted in their cross section to the helical elements 10 and 11 with curved side walls 20 or 23 open at an angle of about 90° into a joining zone 24 in which at both sides of a guide channel 4 extending therefrom there is provided a releasable pin-like exchangeable deflection element 9. The deflection elements 9 have each in their circumferential area cooperating with the helical elements 10 or 11 a groove-like recessed outer face. In the area disposed between the two feed channels 2 and 3, the joining zone 24 is limited by an exchangeable guide element 8 adapted to the helical elements 10 and 11 to be connected. As can be seen from FIG. 6, the joining zone 24 and a part of the guide channel 4 are closed on the upper side by cover plates 45 made of transparent material. One of the cover plates 45 is locked in place by pivot arms 46 which resiliently abut against its upper side and are each rotatable about an associated pivot pin 46A. In the illustrated embodiment there is provided a schematically illustrated cutting device 47 for cutting the pairs of helical elements 12 advanced in the guide channel 4 in a transverse slot of guide channel 4.

The flexible feed pipes 43 are each connected at its end extending towards the supply container with input pieces 44 each of which comprises a passage bore 44A for guiding the helical element 10 or 11, respectively, and at least one injection nozzle 42 discharging into the passage bore obliquely in the feeding direction and connected with a compressed air source, not shown.

In the bottom wall of the input segment of the guide channel 4 there is provided an injection nozzle 41 which is connected with the compressed air source via an air supply pipe 49 and an air supply hose 50. Depending on the requirements, further injection nozzles may be provided in feed channels 2 and 3 and/or in that part of the guide channel 4 which in the feeding direction is downstream the cutting device 47. A feed air flow is generated through the injection nozzles 41 and nozzles 42 in input pieces 44, the feed channels 2 and 3, the joining zone 24 and the guide channel 4 towards the discharge opening thereof, which air flow can be adjusted in its intensity by customary control devices, not shown, and which advances the helical elements 10 or 11 introduced through the input pieces 44 through the feed pipes 43 and the feed channels 2 and 3 towards the joining zone 24 and which further pushes the pair of helical elements 12 formed between the deflection elements 9 forward through the guide channel 4. The interlacing of the helical elements 10 and 11 into a pair of helical elements 12 can be directly observed through the transparent cover plate 45.

The helical element connector 1 is further provided at the discharge end of the guide channel 4 with an insertion head 5 which has a lateral guide wall 32 (FIG. 4) cooperating in its operating position closely above the friction cover 56 of the guide roller 51 with the end positioned helical element 13 of the shackled conveyor belt 14, which guide wall during the movement of the helical element connector 1 for inserting the pair of helical elements 12 slides along the still unconnected part of the end positioned helical element 13 of the shackled conveyor belt 14 thereby aligning and supporting same. The guide wall 32 is disposed in the manner seen from FIG. 2 below about the center of that part of the guide channel 4 which guides the helical element 11. In the illustrated embodiment the guide channel 4 is inclined at an angle of 6° with respect to the end positioned helical element 13 of the shackled conveyor belt 14 disposed on the guide roller 51, so that the end section of the pair of helical elements 12 guided therein is conducted at this angle to the associated segment of the end positioned helical element 13. The bottom wall 31 of the discharge segment of the guide channel 4 is formed by an upper part 48 which can be upwardly pivoted about a pivot axis 48A, and when swung downwardly snaps into the position shown in FIG. 6. The bottom wall 31 of the inclined discharge segment of guide channel 4 further comprises an opening 33 (see FIG. 2) exposing the underside of the spires of the one helical element 11 of the pair of helical elements 12 to be inserted into the end positioned helical element 13 of conveyor belt 14, which opening is formed on the one side of the upper edge of the guide wall 32 and on the other side by the intersection edge of side wall 28 of guide channel 4 with the guide face 34 abutting in the operating position against the upper side of the shackled conveyor belt 14.

At the discharge end of guide channel 4, its bottom wall 31 is extended to a bottom plate 31A at about the center of the width of guide channel 4. As can be seen in FIG. 6 further an arresting device 60 provided with a retractable arresting blade 61 with a forked tip is disposed at the end of guide roller 51. In the operating position of the helical element connector 1, illustrated in FIG. 6, at the start of each insertion operation this arresting blade can project in a blocking manner obliquely upwardly from below into the guide channel 4 at both sides of bottom plate 31*a*, so as to prevent a premature discharge of the pair of helical elements 12 permanently urged in the discharge direction by the feeding air flow. The arresting blade 61 of the arresting device 60 is automatically retracted as soon as the helical element connector at the begin of its displacement to the right in FIG. 6 has pushed the spires of the helical element 11 of the pair of helical elements 12 into the opposed spires of the end positioned helical element 13 of the chackled conveyor belt 14.

While the helical element connector moves away from the arresting device 60 with progressive insertion of the pair of helical elements 12, the connecting wires 15 and 16 are fed from the feeding pipes 62 and 63 schematically shown in FIGS. 5 and 6 into the channels formed by the helical elements 10 and 11 or 11 and 13, respectively in such a manner that their bevelled tips follow at a close distance the displacement of the helical element connector 1 over the width of the shackled conveyor belt 14.

After the helical element connector 1 has moved in the direction of the right arrow of double arrow 40 shown in FIG. 1 to the end of shackled conveyor belt 14 and thereby has finished the insertion of the pair of helical elements 12, the latter is cut off by the cutting device 47. After the completely introduced connecting wires 15 and 16 are also cut off, preferably by a cutting device in an oblique manner (not shown,) the guide roller 51 is rotated by a step corresponding to about the width of one helical element 10 and the helical element connector 1 is moved back into the position shown in FIG. 6 at the opposed end of guide roller 51, whereby the arresting blade 61 is automatically introduced into the guide channel 4. In this position there is started the next insertion step proceeding in the same manner. Since the take-up roller 53 is rotated with a slightly larger circumferential step than the guide roller 51, but on the other hand the weighting or tension roller 52 retains the shackled conveyor belt 14 pressed against both the friction cover 56 of guide roller 51, and the circumferential face of the take-up roller 53, the individual helical elements of the segment of the shackled conveyor belt 14 supported on the guide roller 51 are retained with their spires in abutment with the spires of the next but one helical element, so that the end positioned helical element during the insertion of the pair of helical elements 12 cannot yield in the direction towards weighting roller 52.

The device and the corresponding method described above in conjunction with the preferred embodiment can be modified in different ways by a person skilled in the art depending on requirements, as long as the feeding of two individual helical elements and the generated pair of helical elements occurs by means of a feeding air flow with directly subsequent insertion of the pair of elements is preserved.

We claim:

1. Method for manufacturing a shackled conveyor belt from premade helical elements having alternately a left handed thread and a right handed thread, wherein the spires of adjacent helical elements are alternately pushed into each other and a connecting wire is fed through each channel formed by the interlaced spires of adjacent helical elements, characterized in that (a) pushing two each individual helical elements towards each other in their longitudinal direction at an angle to each other by means of a feeding air flow, (b) parallelly deflecting the two helical elements in the area of their joining by alternating interlacing of their spires so as to form a joined pair of helical elements, (c) pushing a front end of the joined pair of helical elements in a feeding direction by means of a feeding air flow at an acute angle to an associated end section of an end positioned helical element of the prepqred shackled conveyor belt, (d) progressively pushing the spires of one of the two helical elements of the pair of helical elements from its end over the width of the shackled conveyor belt between the opposing spires of the end positioned helical element of the shackled conveyor belt, (e) inserting one connecting wire into each of two channels one of which is formed by the helical elements of the pair of helical elements, and another of which is formed by one of the helical elements and the end positioned helical element of the shackled conveyor belt.

2. Method in accordance with claim 1, characterized in that the two individual helical elements are pushed towards each other by the air flow at an angle of between 60° and 120° and are deflected parallelly at the area of their joining along curved lines in such a manner that their corresponding spires spread apart by the deflection interlace alternately with each other.

3. Method in accordance with claim 2, characterized in that the two individual helical elements are pushed towards each other by the air flow at an angle of between 75° and 105°.

4. Method in accordance with claim 2, characterized in that each of the two individual helical elements is pushed forward by the feeding air flow with adjacent spires in contact with each other.

5. Method in accordance with claim 1 characterized in that the pair of helical elements with the front section in feeding direction of its one helical element is engaged at an acute angle against that side of the end positioned helical element of the shackled conveyor belt which faces away from a surface which guides the shackled conveyor belt and wherein the other helical element of at least an adjacent segment of the shackled conveyor belt is held in such a compressed manner in its longitudinal direction that the spires of each helical element abut against the next but one helical element.

6. Method in accordance with claim 1, characterized in that during the pushing of the spires of the one helical element of the pair of helical elements into the spires of the end positioned helical element of the shackled conveyor belt two connecting wires are simultaneously inserted into the two channels formed by the interlaced spires of the helical elements corresponding to the interlacing progression.

7. Method in accordance with claim 1, characterized in that during the pushing of the spires of the one helical element of the pair of helical elements into the spires of the end positioned helical element of the shackled conveyor belt, the latter is pushed against the adjacent helical element of the shackled conveyor belt and the helical element of the pair of helical elements remote therefrom is supported until the engagement of the associated spires of its other helical element at all sides which are not facing the same.

8. Device for manufacturing a shackled conveyor belt from premade helical elements having alternately a right handed thread and a left handed thread, comprising a helical element connector displaceable over the width of the shackled conveyor belt to be manufactured and having a constricting feeding channel for feeding helical elements interlaced therein with their spires, and means for introducting connecting wires into the channels formed by the interlacing spires of the helical elements, characterized in that (a) the helical element connector (1) comprises two feed channels (2, 3) opening at an angle toward each other into a joining zone (24), each channel for one helical element (10, 11) having a cross section adjusted thereto, and being defined by walls (20, 21 or 22, 23) surrounding the respective helical element (10, 11) guided therein, deflection means (9,25,26) formed in the joining zone (24) into which the helical elements (10, 11) with spreading out their opposing spires are fed from said channels, and a guide channel (4) for receiving a pair of helical elements (12) formed by interlacing of the helical elements (10, 11), said guide channel having a cross section adjusted to said pair and extending from between the deflection means at a blunt angle relative to the feed channels (2, 3), (b) means (41, 42) are provided for generating a feeding air flow directed through the feed channels (2, 3) to the joining zone (24) and further through the guide channel (4) for moving therethrough the helical elements (10, 11) and the pair of helical elements (12), (c) the helical element connector (1) comprises at a discharge end of the guide channel (4) an insertion head (5) for guiding and inserting the segment of only one helical element (11) of the pair of helical elements (12) at an acute angle progressively into the associated end segment of the end-positioned helical element (13) of the shackle conveyor belt (14), and (d) the means for introducing connecting wires are adapted for inserting one connecting wire (15, 16) into each of channels (12*a* or 13*a*) formed by the interlacing spires of the helical elements (10, 11) of the pair of helical elements (12) and by one of the helical elements of said pair and the end positioned helical element (13) of the shackled conveyor belt (14).

9. Device in accordance with claim 8, characterized in that said deflection means include exchangeable deflection elements (9) for deflecting the helical elements (10, 11) which are detachably mounted on both sides of the guide channel (4) at its entrance in the joining zone (24).

10. Device in accordance with claim 9, characterized in that the deflection elements (9) are provided with a groove-like recessed outer face adjusted to the helical elements (10, 11).

11. Device in accordance with claim 10 characterized in that in the area of the joining zone (24) an exchangeable guide element (8) is mounted which is adjusted to the helical elements (10, 11).

12. Device in accordance with claim 9, characterized in that the deflection elements (9) are provided with a concave outer face adjusted to the helical elements (10, 11).

13. Device in accordance with claim 8, characterized in that each feed channel (2, 3) is connected with a flexible feed pipe (43) provided for receiving the associated helical element (10 or 11).

14. Device in accordance with claim 13, characterized in that in each of the feed channels (2, 3) and the feed pipes (43) and the guide channel (4), at least one injection nozzle (41, 21) is provided closeably connected with a compressed air source for generating the feeding air flow.

15. Device in accordance with claim 8, characterized in that a cutting device (47) is provided in the guide channel (4) for cutting the pair of helical elements (12).

16. Device is accordance with claim 8, characterized in that the joining zone (24) is provided with a transparent cover (45).

17. Device in accordance with claim 8, wherein the helical element connector (1) is displaceably guided between an operating position and inoperating position over a support face (51) receiving the shackled conveyor belt (14) parallel to the end positioned helical element (13) of the shackled conveyor belt (14), the insertion head (5) comprising a guide wall (32) cooperating in its operating position closely above the support face (51) with the end positioned helical element (13) of the shackled conveyor belt (14), said guide wall being slidable along a still non-connected part of the end positioned helical element (13) during the displacement of the helical element connector (1) for inserting the one helical element (11) of the pair of helical elements (12) into the end positioned helical element (13) of the shackled conveyor belt (14).

18. Device in accordance with claim 17, characterized in that the helical element connector (1) comprises a bottom face abutting in the operating position with a light free play against the support face (51), and a guide face (34) abutting in the operating position against that side of the end segment of the shackled conveyor belt (14) which faces away from said support face (51).

19. Device in accordance with claim 17, characterized in that the guide channel (4) opens at the insertion head (5) at an angle of no more than 10° relative to the support face (51) of the shackled conveyor belt (14).

20. Device in accordance with claim 17, characterized in that the guide channel is formed with an inclined discharge segment having a bottom wall (31) in which an opening (33) is provided exposing the bottom side of the spires of the helical element to be inserted into the end positioned helical element (13) of shackled conveyor belt (14).

21. Device in accordance with claim 8, characterized by an arresting device (60) with an arresting member (61) introducable into the guide channel (4) for blocking a discharge of the pair of helical elements (12) guided therein.

22. Device in accordance with claim 8, characterized in that an upperpart (48) is provided which is pivotally connected to the insertion head (5) for forming a cover wall (30) and a side wall (28) of the discharge segment of the guide channel (4) in the proximity of the shackled conveyor belt (14).

23. Device in accordance with claim 8, characterized in that at least part of the guide channel is provided with a transparent cover.

* * * * *